US009215913B2

(12) United States Patent
Bisserier

(10) Patent No.: US 9,215,913 B2
(45) Date of Patent: Dec. 22, 2015

(54) ROTATABLE RING BIVALVE HOUSING

(71) Applicant: Claude Bisserier, Oak Park, CA (US)

(72) Inventor: Claude Bisserier, Oak Park, CA (US)

( * ) Notice: Subject to any disclaimer, the term of this patent is extended or adjusted under 35 U.S.C. 154(b) by 229 days.

(21) Appl. No.: 14/083,280

(22) Filed: Nov. 18, 2013

(65) Prior Publication Data

US 2014/0075989 A1 Mar. 20, 2014

Related U.S. Application Data

(63) Continuation of application No. PCT/US2012/038692, filed on May 18, 2012.

(60) Provisional application No. 61/488,658, filed on May 20, 2011.

(51) Int. Cl.
*A44C 9/00* (2006.01)

(52) U.S. Cl.
CPC .. *A44C 9/00* (2013.01); *A44C 9/003* (2013.01)

(58) Field of Classification Search
None
See application file for complete search history.

(56) References Cited

U.S. PATENT DOCUMENTS

| | | | | | |
|---|---|---|---|---|---|
| 1,596,642 | A | * | 8/1926 | Weber | A44C 9/00 63/15.4 |
| 2,220,408 | A | * | 11/1940 | Kalina | A44C 9/0015 63/15 |
| 2,462,425 | A | | 2/1949 | Pratt et al. | |
| 5,228,316 | A | | 7/1993 | Meyrowitz | |
| 5,228,317 | A | * | 7/1993 | Hendricks | A44C 17/0208 63/15.7 |
| 5,253,490 | A | | 10/1993 | Doganay | |
| 5,419,158 | A | | 5/1995 | Sandberg et al. | |
| 5,596,887 | A | | 1/1997 | Bergagnini | |
| 5,678,428 | A | | 10/1997 | Pasquetti | |
| 2006/0090511 | A1 | | 5/2006 | Boone | |

OTHER PUBLICATIONS

Written Opinion and International Search Report for PCT/US2012/038692, mailed Aug. 7, 2012.

* cited by examiner

*Primary Examiner* — Jack W Lavinder
(74) *Attorney, Agent, or Firm* — Brooks Acordia IP Law, P.C.; Pejman Yedidsion; Christopher Weiss

(57) ABSTRACT

A rotatable bivalve housing comprising a first annular structure and a second annular structure that may be fixedly engaged with one another to provide a circular volume within which a rotatable ring, or a rotatable ring structure, may be securely rotated. Additionally, the first annular structure may be fixedly engaged with the second annular structure, each annular structure having one or more arcuate bow structures extending outwardly from the portion of the annular structure supportive of the rotatable ring.

14 Claims, 8 Drawing Sheets

ROTATABLE RING BIVALVE HOUSING

CROSS REFERENCE TO RELATED APPLICATIONS

This application is a continuation of International Application No. PCT/US12/38692 filed May 18, 2012, which claims priority to and the benefit of U.S. Provisional Application No. 61/488,658 filed May 20, 2011, the disclosures of both of which are incorporated by reference herein for all purposes.

TECHNICAL FIELD

Embodiments pertain to jewelry ring assemblies and particularly to annular structures having one or more arcuate bow structures.

BACKGROUND

U.S. Pat. No. 5,678,428 to Pasquetti discloses an annular piece of jewelry, particularly a ring or a bracelet having an outer rotary crown.

SUMMARY

The rotatable bivalve housing comprises a first annular structure and a second annular structure that may be fixedly engaged with one another to provide a circular volume within which a rotatable ring, or a rotatable ring structure, may be securely rotated. To fixedly engage the first annular structure with the second annular structure, each annular structure may have one or more arcuate bow structures extending outwardly from the portion of the annular structure supportive of the rotatable ring.

Accordingly, the embodiments may include an article of jewelry comprising a first annular element comprising at least two protruding tongues; a second annular element comprising at least two openings for receiving the at least two protruding tongues of the first annular element; and a space for a removable third annular element between the first annular element and the second annular element. Additional embodiments may further comprise a first annular element locking element comprising one or more clasp tongues; and a second annular element locking element comprising one or more branches for engaging the one or more clasp tongues of the first annular element. Other exemplary embodiments may further comprise a first rim connected to the first annular element; and a second rim connected to the second annular element, where the first rim and the second rim interlock in parallel along a plane defined by a cross section of an inner aperture of the first annular element and the second annular element. In other exemplary embodiments, at least one of the following surfaces may be composed of set stones: the first annular element, the second annular element, and a third annular element between the first annular element and the second annular element. In additional exemplary embodiments, a clasp tongue may be shaped to avoid contact with a culet of the at least one surface composed of set stones.

Embodiments may also include a ring comprising a first annulus having an inner flange perimeter; a second annulus having an outer flange perimeter, where the outer flange perimeter engages the inner flange perimeter; a ring interposed between the first annulus and the second annulus; a set of three or more arcuate support structures extending outwardly from the first annulus; and a set of three or more arcuate support structures extending outwardly from the second annulus. In additional exemplary embodiments, the set of three or more arcuate support structures extending outwardly from the first annulus may engage the set of three or more arcuate support structures extending outwardly from the second annulus.

Embodiments may also include an ornamental ring comprising a first valve having a first rim and a second valve having a second rim, the first valve having at least one arcuate arm extending from the first rim, where at least one of: a post, a receiver, and a resilient clasp may be disposed at a distal end of the at least one arcuate arm of the first rim, and the second valve having at least one arcuate arm extending from the second rim, wherein at least one of: a post, a receiver, and a resilient clasp may be disposed at a distal end of the at least one arcuate arm of the second rim. In additional exemplary embodiments, at least one of: the post, the receiver, and the resilient clasp of the at least one arcuate arm of the first rim may be configured to receive at least one of: a post, a receiver, and a resilient clasp of the at least one arcuate arm of the second rim.

BRIEF DESCRIPTION OF THE DRAWINGS

Embodiments are illustrated by way of example and not limitation in the figures of the accompanying drawings, and in which.

DETAILED DESCRIPTION

Figure 1:
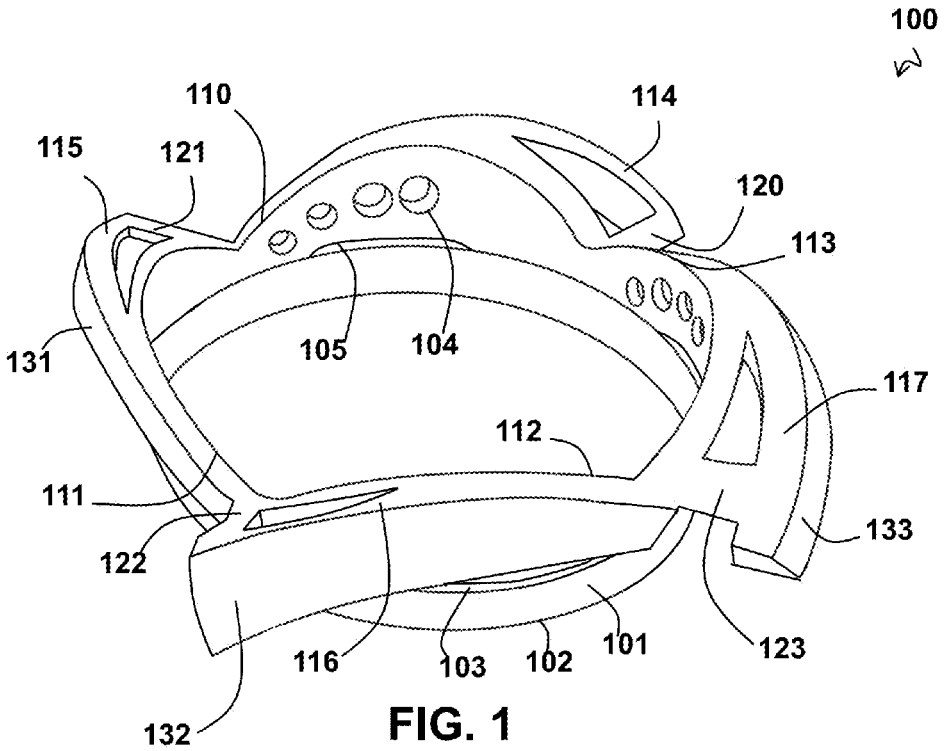
FIG. 1 is a perspective view of an exemplary first annular structure embodiment.

FIG. 1 is a perspective view of an exemplary first annular structure embodiment 100. The first annular structure comprises a first cylindrical band 101 having a first rim 102 and a second rim 103. A plurality of arcuate bow structures 114-117 each extend from the second rim 103 of the first cylindrical band 101 coextensive with a portion of the circumference of the second rim 103. A plurality of arcuate ring support structures 110-113 extend from the outer surface of the first cylindrical band 101, each proximal to an associated arcuate bow structure 114-117. A plurality of chord structures 120-123 extend tangentially from the outer surface of the first cylindrical band 101 and each engage a portion of at least one of the plurality of arcuate ring support structures 110-113 that is distal from the associated one of a plurality of arcuate bow structures 114-117.

Figure 2:
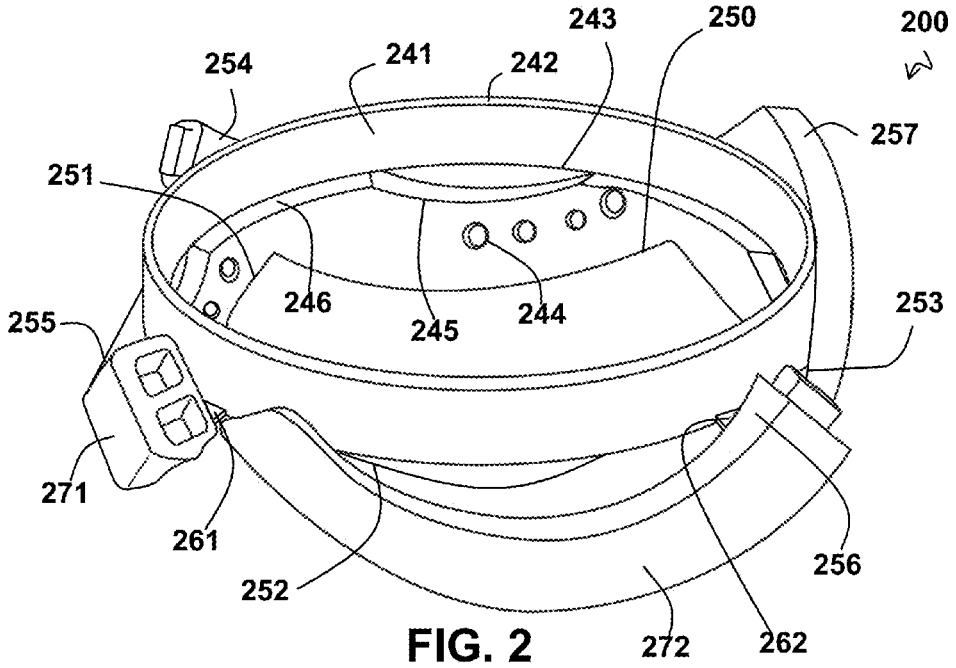
FIG. 2 is a perspective view of an exemplary second annular structure embodiment.

FIG. 2 is a perspective view of an exemplary second annular structure embodiment 200. The second annular structure comprises a second cylindrical band 241 having a first rim 242 and a second rim 243. A plurality of arcuate bow structures 254-257 each extend from the second rim 243 of the second cylindrical band 241 coextensive with a portion of the circumference of the second rim 243. A plurality of arcuate ring support structures 250-253 extend from the outer surface of the second cylindrical band 241, each proximal to an associated arcuate bow structure 254-257. A plurality of chord structures 261,262 extend tangentially from the outer surface of the second cylindrical band 241 and each engage a portion of at least one of the plurality of arcuate ring support structures 250-253 that is distal from the associated one of a plurality of arcuate bow structures 254-257. The second annular structure may comprise a lip 246, or ledge, where the first rim 102 of the first cylindrical band 101 of the first annular structure (FIG. 1) may be proximate to, or in contact with, the lip 246 of the second annular structure when the first cylindrical structure is engaged with the second annular structure.

Figure 3:
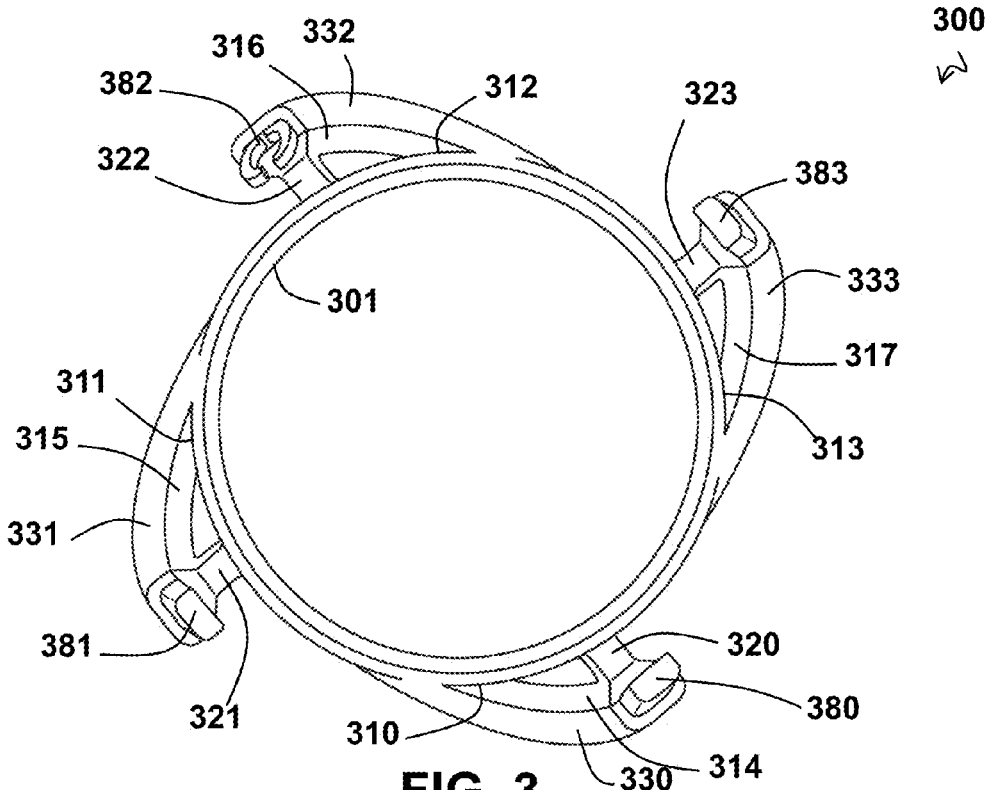
FIG. 3 is a bottom view of an exemplary first annular structure with one clasp and three extended pin elements.

FIG. 3 may be referenced as a bottom view of an exemplary first annular structure 300 with one clasp 382 and three extended pin elements 380,381,383. An exemplary first annular structure 300 embodiment may comprise end portions of at least one of the pluarity of arcuate ring support structures 310-313 that is distal from the associated arcuate bow structures 314-317 comprising a clasp 382 and three extended pin elements 380,381,383. The clasp 382 may be a split-tongue clasp. A portion 330-333 of the at least one arcuate bow structures 314-317 may be covered by one or mounted objects, e.g., jewels. The clasp 382 may have an engagement portion recessed about the one or more mounted objects. The first annular structure 300 may comprise at least one chord structure 320-323.

Figure 4:
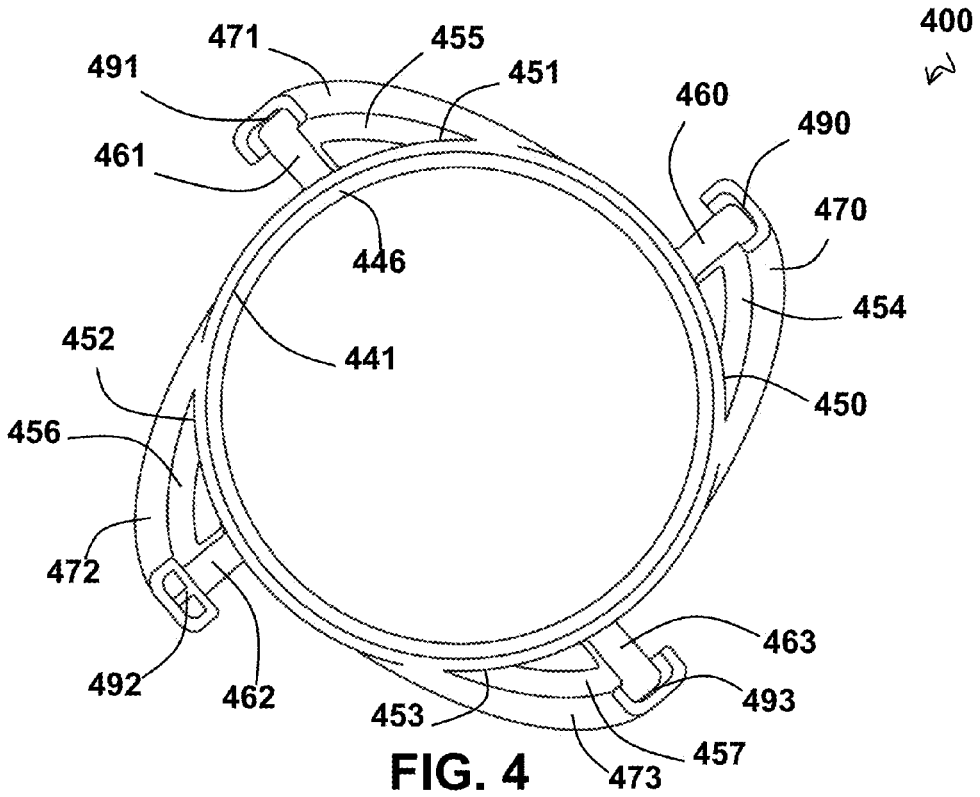
FIG. 4 is a top view of an exemplary second annular structure with one pin element and three cavities.

FIG. 4 is a top view of an exemplary second annular structure 400 with one pin element 492 and three cavities 490,491,493. An exemplary second annular structure 400 embodiment may comprise end portions of at least one of the pluarity of arcuate ring support structures 450-453 that is distal from the associated arcuate bow structures 454-457 comprising a pin element 492 and three cavities 490,491,493. The pin element 492 may be a transverse-pin element. A portion 470-473 of the at least one arcuate bow structures 454-457 may be covered by one or mounted objects, e.g., jewels. The second annular structure 400 may comprise at least one chord structure 460-463. The second cylindrical band 441 may have an inner diameter greater than the outer diameter of the first cylindrical band 301 (FIG. 3), such that the first annular structure 300 and the second annular structure 400 may be engaged. When the first cylindrical structure 300 is engaged with the second annular structure 400, the first cylindrical band 301 of the first annular structure 300 may be proximate to, or in contact with, the lip 446 of the second annular structure 400, where the inner diameter of the second cylindrical band 441 may be greater than the inner diameter of the lip 446. The pin element 492 may receive the clasp 382 (FIG. 3), and the three cavities 490,491,493 may each receive an associated one of the three extended pin elements 380,381, 383 (FIG. 3).

Figure 5:
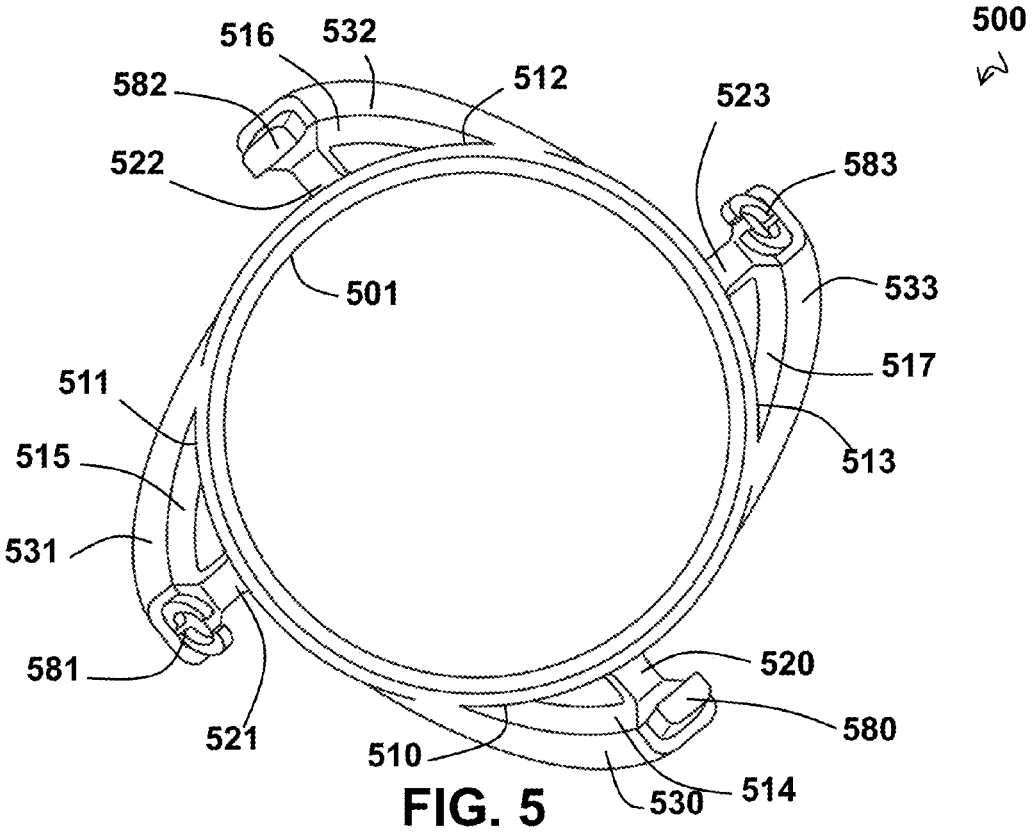
FIG. 5 is a bottom view of an exemplary first annular structure with two clasps and two extended pin elements.
Figure 6:
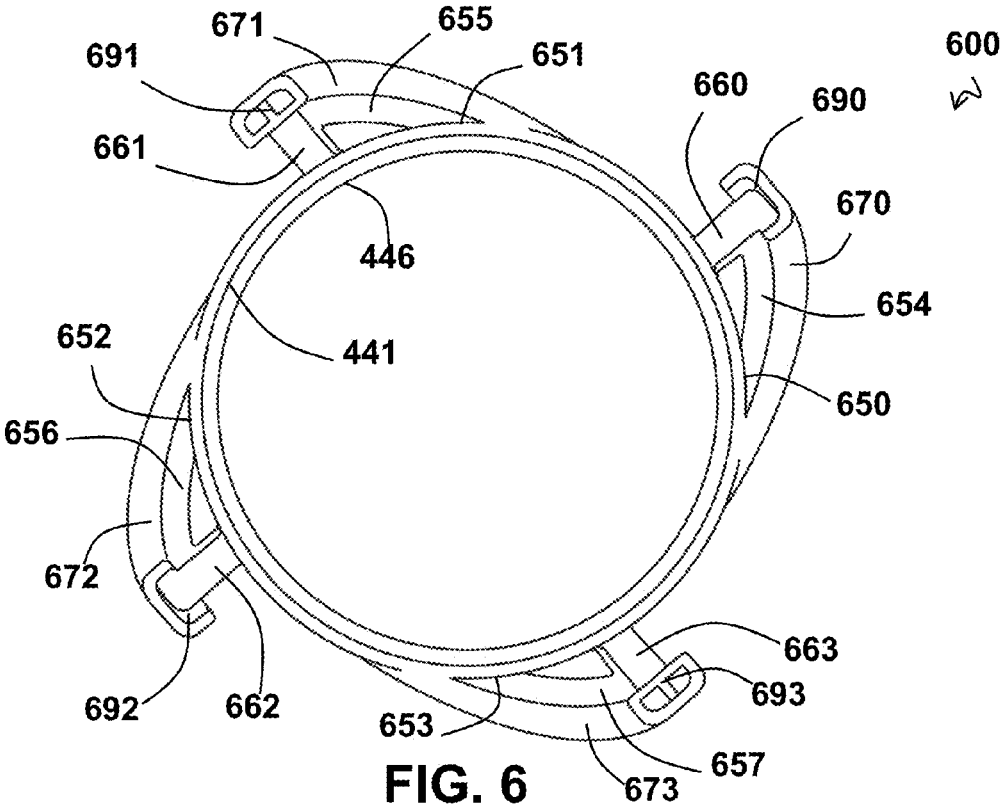
FIG. 6 is a top view of an exemplary second annular structure with two pin elements and two cavities.

FIG. 5 is a bottom view of an exemplary first annular structure 500 with two clasps 581,583 and two extended pin elements 580,582. FIG. 6 is a top view of an exemplary second annular structure 600 with two pin elements 691,693 and two cavities 690,692. Exemplary embodiments of the first annular structure 500 may comprise a combination of extended pin elements 580,582 and clasps 581,583. Exemplary embodiments of the second annular structure 600 may comprise varying combinations of corresponding pin elements 691,693 configured to each receive one or more clasps 581,583 and corresponding cavities 690,692 configured to each receive one or more extended pin elements 580,582.

Figure 7:
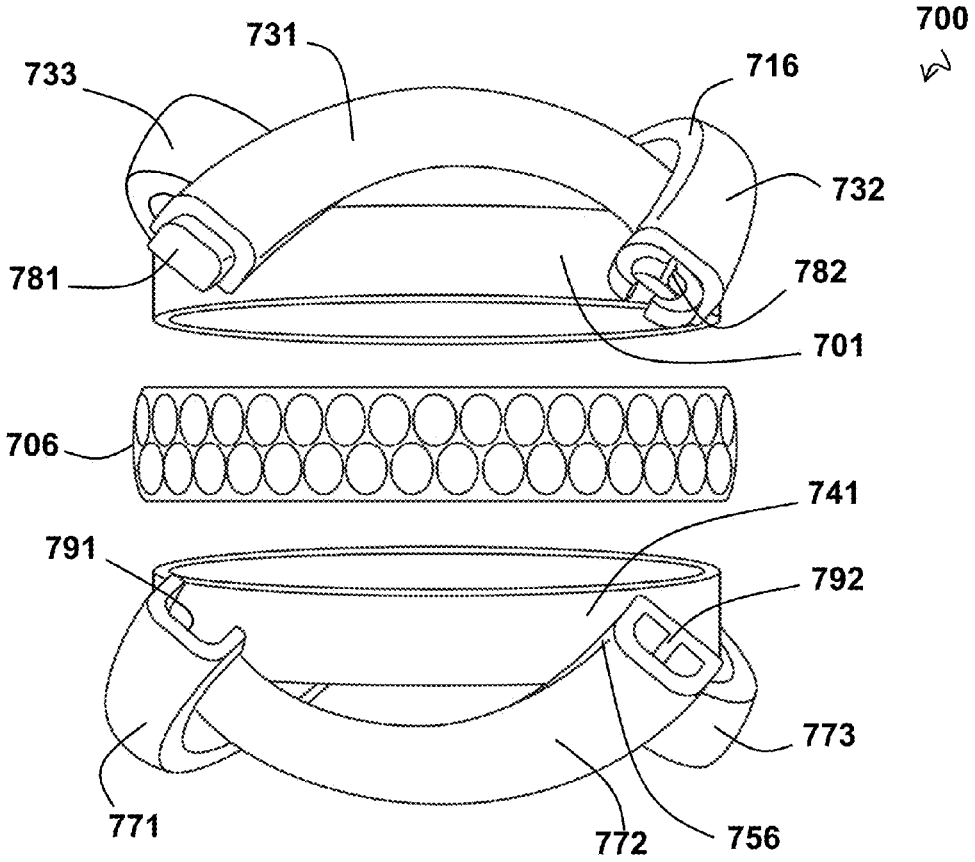
FIG. 7 is a side exploded view of an exemplary embodiment with a first annular structure, second annular structure, and a ring element.

FIG. 7 is a side exploded view of an exemplary embodiment 700 with a first annular structure, second annular structure, and a ring element 706. The first cylindrical band 701 may have an outer diameter less than the inner diameter of the second cylindrical band 741. The ring element 706 may have an inner diameter greater than the outer diameter of the second cylindrical band 741.

Figure 8:
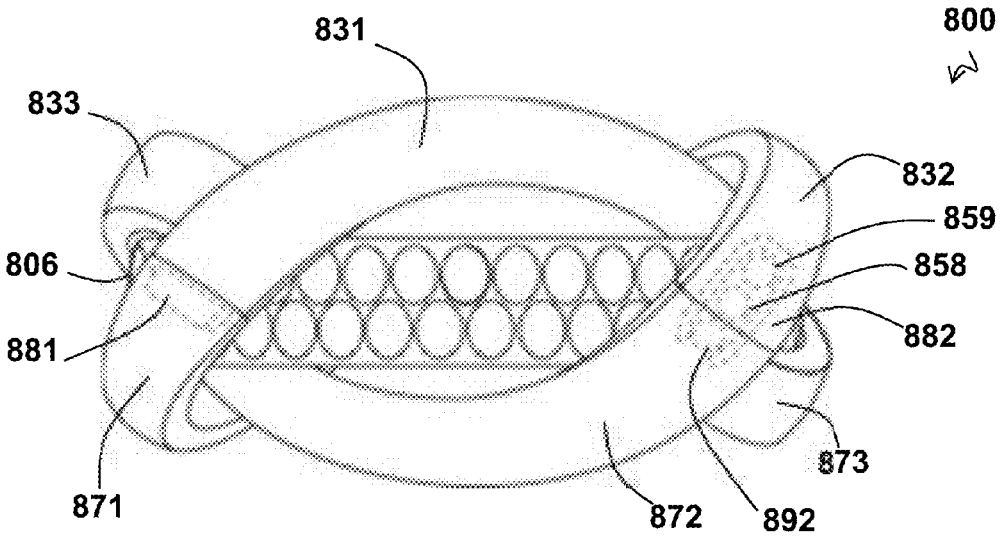
FIG. 8 is a side view of an exemplary embodiment with a first annular structure, second annular structure, and a ring element showing an exemplary clasp engaging an exemplary pin element and an exemplary extended pin element engaging an exemplary cavity.

FIG. 8 is a side view of an exemplary embodiment 800 with a first annular structure, second annular structure, and a ring element 806. The pin element 892 of the second annular structure may be configured to receive the clasp 882 of the first annular structure. The cavity 791 of the second annular structure may be configured to receive the extended pin element 781 of the first annular structure. A portion 831-833, 871-873 of the at least one arcuate bow structure may be covered by one or mounted objects, e.g., jewels. The clasp 882 may have extended sides so as to allow for one or more mounted objects positioned on, and extending through 858, 859, a portion of the arcuate bow structure between the sides of the clasp, such that the operation of the clasp may not be impeded by the one or more mounted objects. The ring element 806 may also be covered by one or mounted objects, e.g., jewels. Accordingly, at least one of the each arcuate bow structures of the first annular structure and the second annular structure may appear to be one continuous arcuate bow structure when the first annular structure is enagaged to the second annular structure.

Figure 9:
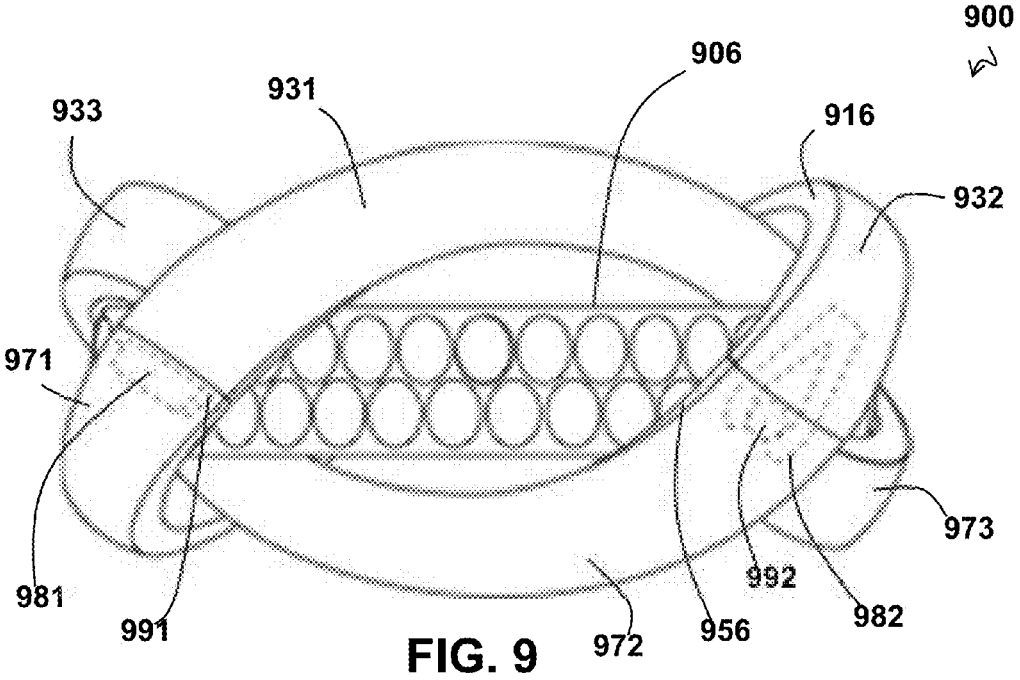
FIG. 9 is a side view of an exemplary embodiment with a first annular structure, second annular structure, and a ring element showing an exemplary clasp engaging an exemplary pin element and an exemplary extended pin element engaging an exemplary cavity.

FIG. 9 is a side view of an exemplary embodiment 900 with a first annular structure, second annular structure, and a ring element 906 showing an exemplary clasp 982 engaging an exemplary pin element 992 and an exemplary extended pin element 981 engaging an exemplary cavity 991. The clasp 982 may have an engagement portion recessed about the one or more mounted objects. The clasp 982 may have closer sides, compared to the clasp 882 (FIG. 8), if there are no mounted objects, e.g., jewels, disposed directly above the clasp 982 on a portion of the arcuate bow structure 932.

Figure 10:
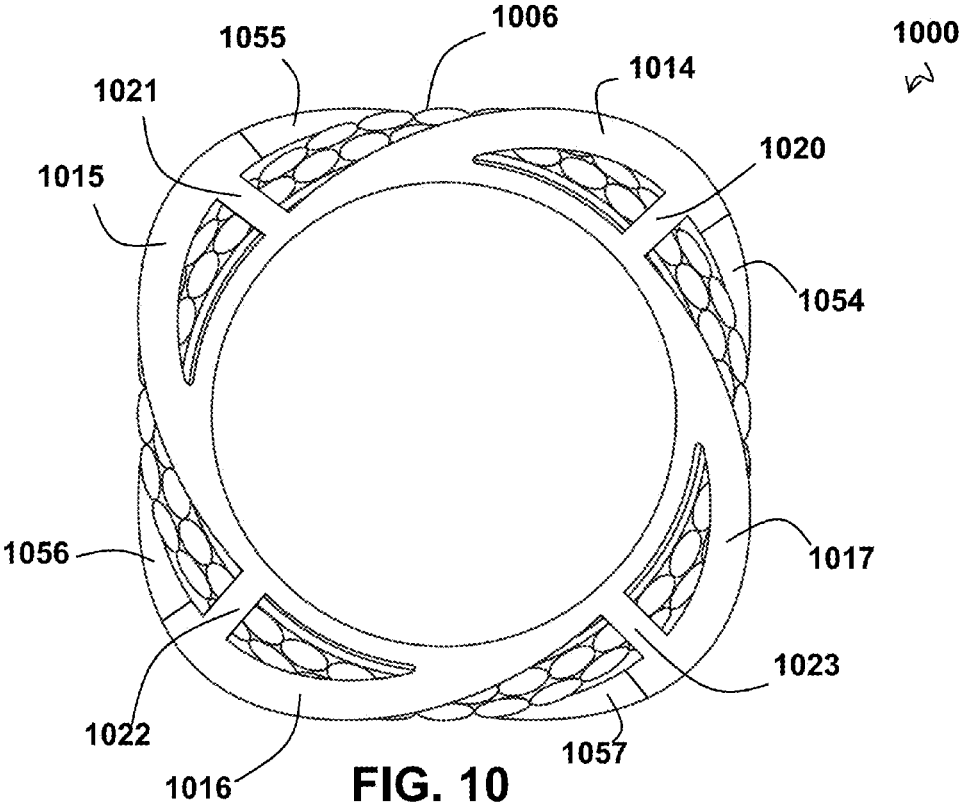
FIG. 10 is a top view of an exemplary embodiment with a first annular structure, second annular structure, and a ring element.

FIG. 10 is a top view of an exemplary embodiment 1000 with a first annular structure, second annular structure, and a ring element 1006. The ring element 1006 may be limited in lateral travel by at least one chord structure 1020-1023 extending away, e.g., extending tangentially, from the outer surface of the cylindrical band.

Figure 11:
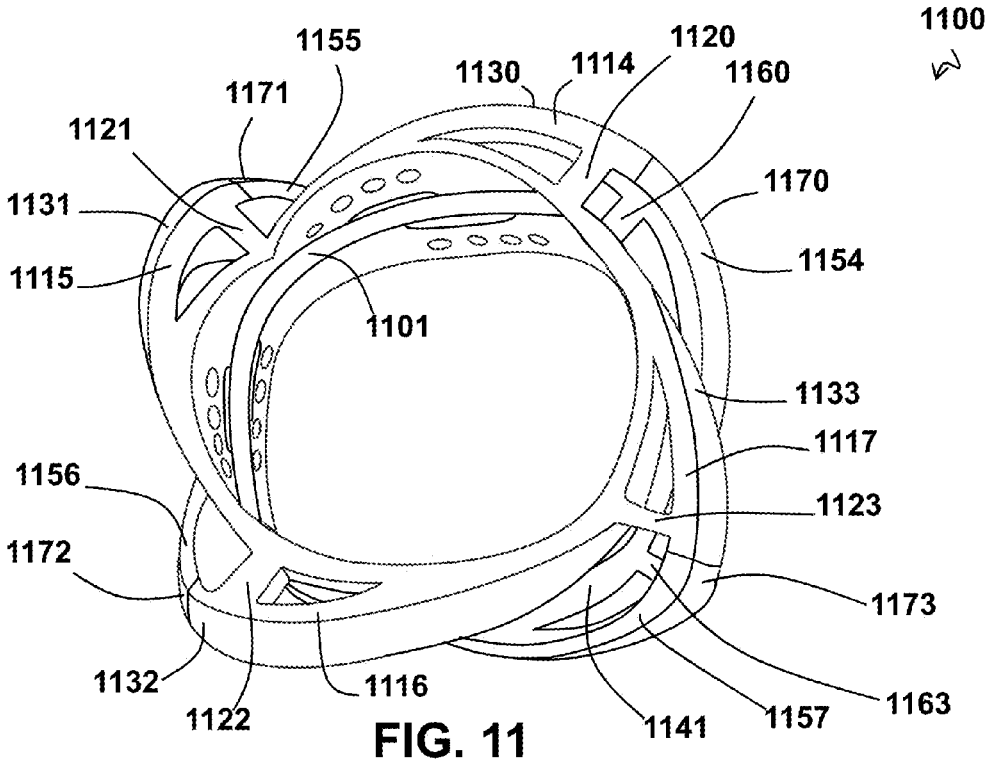
FIG. 11 is a perspective view of an exemplary embodiment with a first annular structure and a second annular structure.

FIG. 11 is a perspective view of an exemplary embodiment 1100 with a first annular structure and a second annular structure. The first cylindrical band 1101 may be disposed within the second cylindrical band 1141, where the inner diameter of the second cylindrical band 1141 is greater than the outer diameter of the first cylindrical band 1101. A portion 1130-1133,1170-1173 of the at least one arcuate bow structures 1114-1117,1154-1157 may be covered by one or mounted objects, e.g., jewels.

Figure 12:
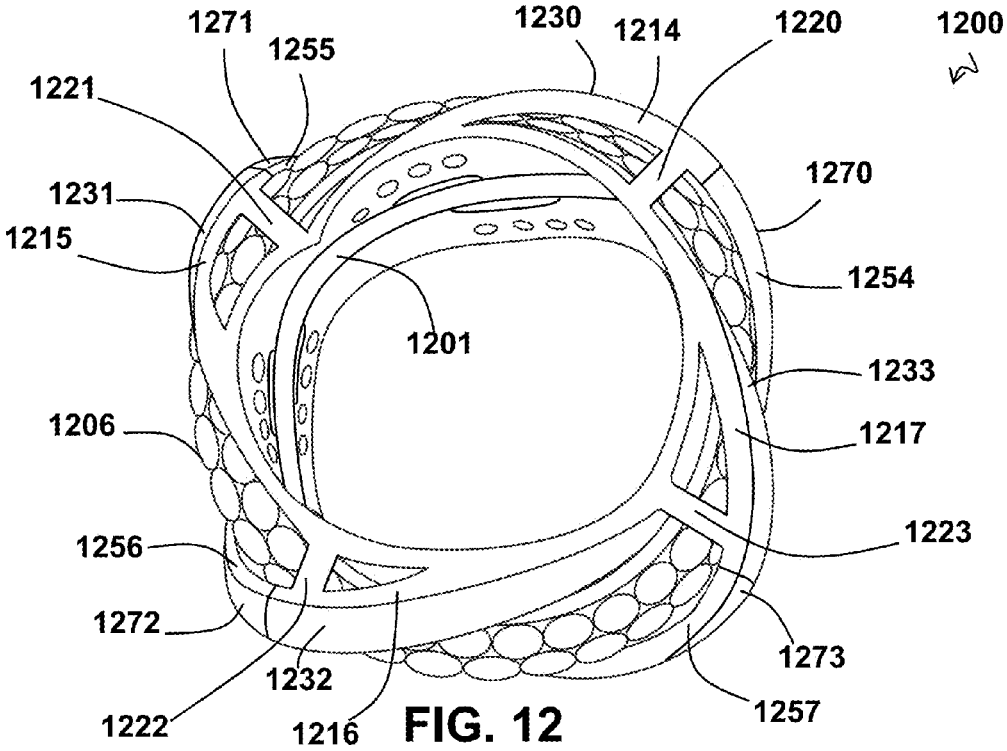
FIG. 12 is a perspective view of an exemplary embodiment with a first annular structure, second annular structure, and a ring element.

FIG. 12 is a perspective view of an exemplary embodiment 1200 with a first annular structure, second annular structure, and a ring element 1206. The ring element 1206 may be limited in lateral travel by at least one chord structure of the first annular structure 1220-1223 and at least one chord structure of the second annular structure 1160,1163 (FIG. 11). The ring element 1206 may rotate about the annular structure, where the inner diameter of the ring element 1206 is greater than the outer diameter of the second annular structure. The ring element may be covered by one or more mounted objects, e.g., jewels, where the height of the one or more mounted objects may be lower, extending tangentially outward from the cylindrical band, than the height of the one or more arcuate bow structures 1214-1217 outward, about the cylindrical band.

Figure 13:
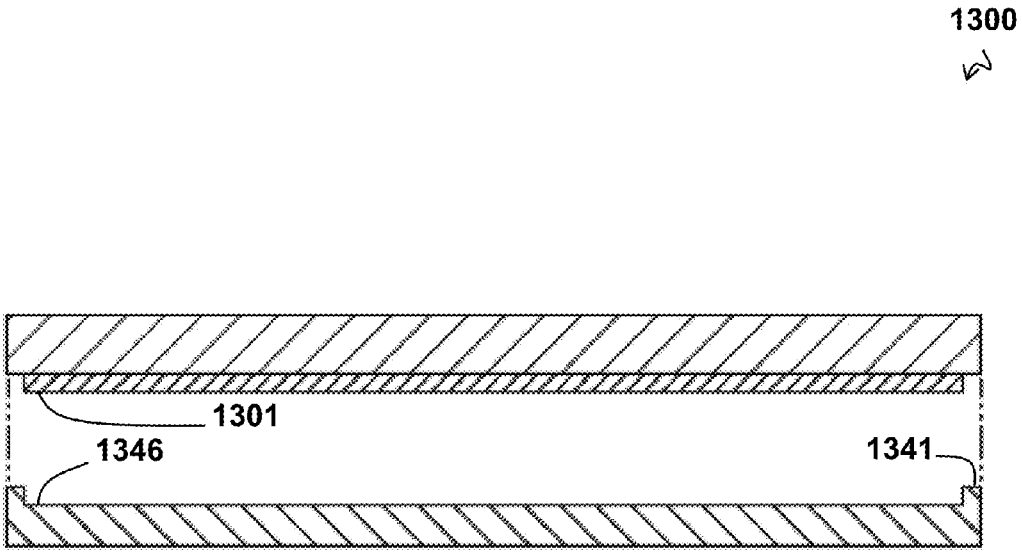
FIG. 13 is a cross-section side view of a rim of an exemplary first annular structure and a lip of an exemplary second annular structure.
Figure 14:
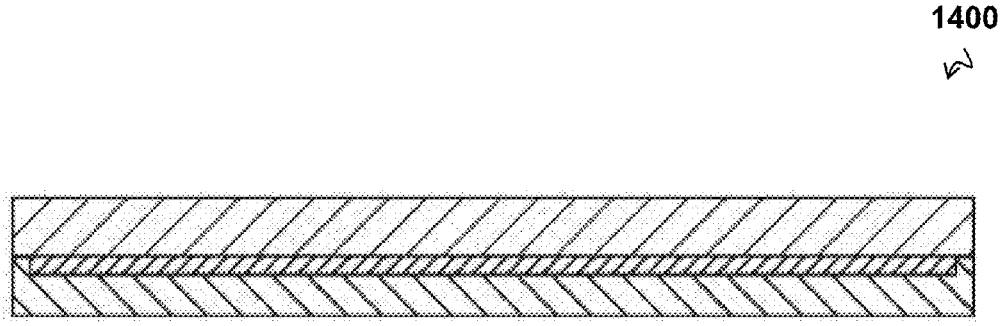
FIG. 14 is a cross-section side view of a rim of an exemplary first annular structure engaged with a lip of an exemplary second annular structure.

FIG. 13 is a cross-sectional side view of a rim of an exemplary first annular structure and a lip of an exemplary second annular structure 1300. FIG. 14 is a cross-sectional side view of a rim of an exemplary first annular structure engaged with a lip of an exemplary second annular structure 1400.

Figure 15:
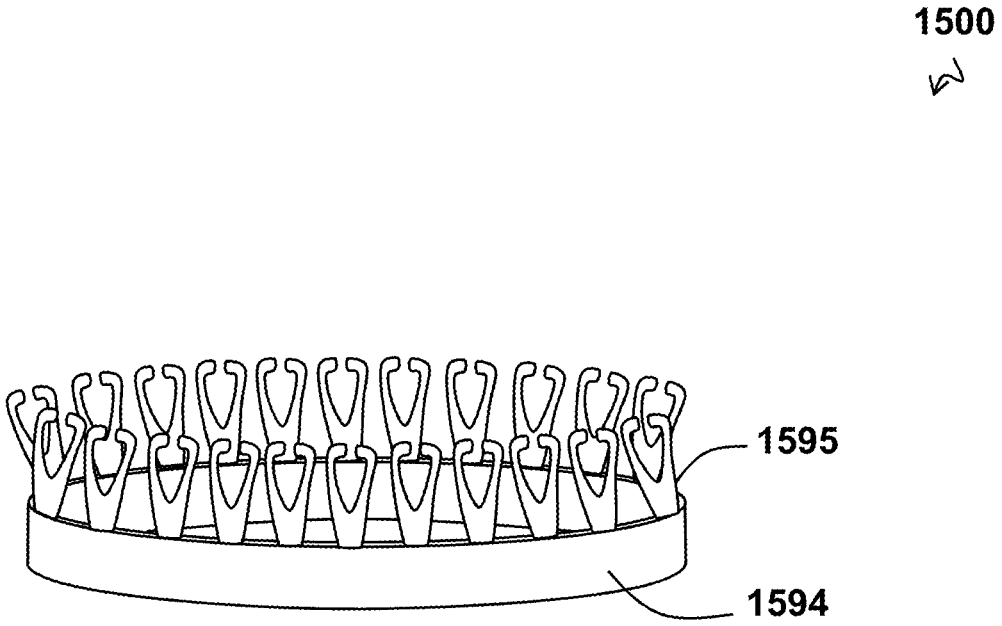
FIG. 15 is a perspective view of multiple clasp blanks of an exemplary assembly embodiment.
Figure 16:
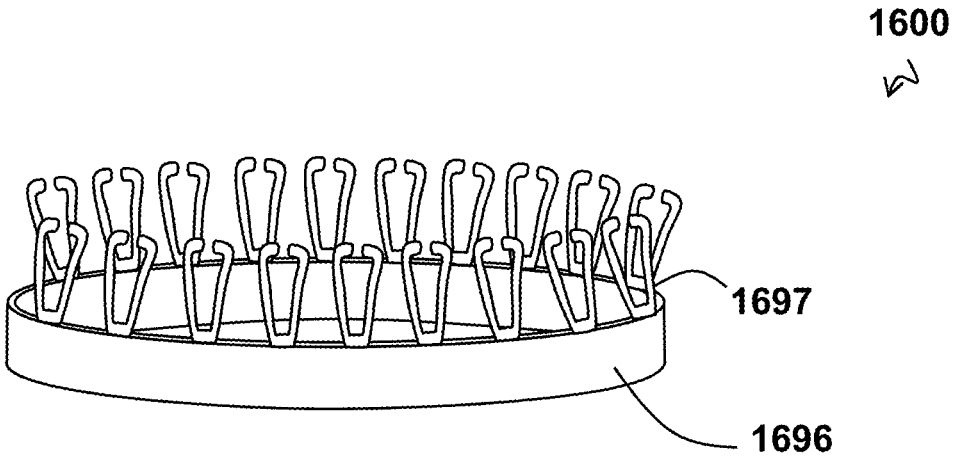
FIG. 16 is a perspective view of multiple clasp blanks of another exemplary assembly embodiment.

FIG. 15 is a perspective view of multiple clasp blanks of an exemplary assembly embodiment 1500. An exemplary blank 1594 comprises at least one exemplary pinch clasp 1595. FIG. 16 is a perspective view of multiple clasp blanks of another exemplary assembly embodiment 1600. An exemplary blank 1696 comprises at least one exemplary pinch clasp 1697. The exemplary pinch clasps 1594,1696 may have varying dimensions for the sides to accommodate embodiments with mounted objects that may protrude into an area between the sides of the pinch clasps.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention herein disclosed by way of examples should not be limited by the particular disclosed embodiments described above.

What is claimed is:

1. An article of jewelry comprising:

a first cylindrical band having a first rim, the first cylindrical band having at least one arcuate arm extending from the first rim, wherein at least one of: a post, a receiver, and a resilient clasp are disposed at a distal end of the at least one arcuate arm of the first rim;

at least one first chord structure, wherein the at least one first chord structure extends in a radial direction, outwardly directed from the first rim of the first cylindrical band and engages a distal portion of the at least one arcuate arm of the first rim;

a second cylindrical band having a second rim, the second cylindrical band having at least one arcuate arm extending from the second rim, wherein at least one of: a post, a receiver, and a resilient clasp are disposed at a distal end of the at least one arcuate arm of the second rim, and wherein at least one of: the post, the receiver, and the resilient clasp disposed at the distal end of the at least one arcuate arm of the second rim engages at least one of: the post, the receiver, and the resilient clasp disposed at the distal end of the at least one arcuate arm of the first rim; and at least one second chord structure, wherein the at least one second chord structure extends in a radial direction, outwardly directed from the second rim of the second cylindrical band and engages a distal portion of the at least one arcuate arm of the second rim.

2. The article of jewelry of claim 1, wherein the at least one resilient clasp is a split-tongue clasp.

3. The article of jewelry of claim 1, wherein the post is a transverse-pin element, the transverse-pin element configured to engage the receiver.

4. The article of jewelry of claim 1, wherein the first cylinder band further comprises an inner flange perimeter, wherein the second cylinder band further comprises an outer flange perimeter, and wherein the outer flange perimeter is configured to engage the inner flange perimeter.

5. The article of jewelry of claim 1, wherein the first cylindrical band further comprises three arcuate arms extending from the first rim, wherein the second cylindrical band further comprises three arcuate arms extending from the second rim, and wherein the three arcuate arms extending from the first rim are configured to engage the three arcuate arms extending from the second rim.

6. The article of jewelry of claim 1 further comprising:

a space for a removable annular element between the first cylindrical band and the second cylindrical band.

7. The article of jewelry of claim 6 further comprising:

an annular element interposed between the first cylindrical band and the second cylindrical band in the space for the removable annular element.

8. The article of jewelry of claim 7, wherein the annular element is rotatable relative to a plane defined by a cross section of an inner aperture of the first cylindrical band and the second cylindrical band.

9. The article of jewelry of claim 7, wherein the at least one first chord structure and the at least one second chord structure laterally constrain the movement of the annular element interposed between the first cylindrical band and the second cylindrical band.

10. The article of jewelry of claim 1, wherein the first rim and the second rim interlock in parallel along a plane defined by a cross section of an inner aperture of the first cylindrical band and the second cylindrical band.

11. The article of jewelry of claim 1, wherein the at least one of: the post, the receiver, and the resilient clasp of the at least one arcuate arm of the first rim is configured to receive the at least one of: the post, the receiver, and the resilient clasp of the at least one arcuate arm of the second rim.

12. The article of jewelry of claim 11, wherein at least one of a surface of the first cylindrical band and a surface of the second cylindrical band is comprised of one or more set stones.

13. The article of jewelry of claim 12, wherein the at least one resilient clasp is shaped to avoid contact with a culet of the at least one surface comprised of one or more set stones.

14. The article of jewelry of claim 12, wherein the least one of: the post, the receiver, and the resilient clasp are recessed about at least one of the one or more set stones.

* * * * *